United States Patent [19]

Biggar

[11] Patent Number: 4,961,613

[45] Date of Patent: Oct. 9, 1990

[54] DISPENSING CABINET FOR STRIP MATERIAL

[75] Inventor: R. Warren Biggar, Burlington, Canada

[73] Assignee: Frost Products Limited, Hamilton, Canada

[21] Appl. No.: 423,300

[22] Filed: Oct. 18, 1989

[51] Int. Cl.[5] ..... B65H 19/00

[52] U.S. Cl. ..... 312/38; 225/52; 225/79; 242/55.53

[58] Field of Search ..... 312/37, 38, 39; 225/51, 225/52, 79, 82, 84, 87; 242/55.53

[56] References Cited

U.S. PATENT DOCUMENTS

| | | | |
|---|---|---|---|
| 1,231,797 | 7/1917 | Shelley | 312/39 |
| 2,243,686 | 5/1941 | Steiner et al. | 242/55.5 |
| 2,457,439 | 12/1948 | Birr . | |
| 2,592,786 | 4/1952 | Birr . | |
| 2,601,956 | 7/1952 | Birr . | |
| 3,017,131 | 1/1962 | Wooster | 242/55.53 |
| 3,040,943 | 6/1962 | Bump | 225/52 |
| 3,410,465 | 11/1968 | Costello | 225/82 X |
| 4,203,562 | 5/1980 | Deluca et al. | 242/55.53 |
| 4,718,220 | 1/1988 | Van Rosendal et al. | 242/55.53 |
| 4,790,490 | 12/1988 | Chakravorty | 242/55.53 |

*Primary Examiner*—Joseph Falk
*Attorney, Agent, or Firm*—Rogers & Scott

[57] ABSTRACT

A dispensing cabinet for strip material, such as paper towel, has a relatively large handwheel extending through a slot in the front face. A roll of the material is engaged by a boss member on the wheel so as to be rotated by rotation of the handwheel. The edge of the handwheel is provided with radially-extending protrusions constituting both finger engaging members to help the user rotate the handwheel and ratchet teeth engageable by a ratchet member mounted on a pivoted plate mounted adjacent the horizontal cabinet slot through which the strip is dispensed. The ratchet member is normally clear of the ratchet teeth, but any attempt to pull the strip from the roll engages the ratchet member with a tooth so that the roll cannot rotate; the strip can therefore only be dispensed by operation of the handwheel, reducing the tendency to dispense a wastefully long strip. The dispensed portion is torn from the remainder of the roll by pulling it strongly against the lower edge of the plate, which also engages the ratchet so that the roll cannot rotate during the tearing operation.

8 Claims, 3 Drawing Sheets

DISPENSING CABINET FOR STRIP MATERIAL

FIELD OF THE INVENTION

This invention is concerned with improvements in or relating to dispensing cabinets for strip material, such as are used for example in washrooms to dispense paper towel from a continuous roll thereof.

REVIEW OF THE PRIOR ART

Paper towel can be dispensed either from a stack of separate sheets, usually interleaved to permit automatic feed, or from a continuous roll. The roll form is more economical to produce, but the dispenser must then provide some means for feeding a sufficient length of the strip and severing it from the remainder of the roll, while at the same time restraining the user in as unobtrusive manner a manner as possible from taking too much at one time, with consequent wastage of an increasingly expensive material. A number of prior cabinet structures have been proposed for this purpose, but generally employ levers and/or gears for the controlled strip feed, with consequent expense in initial manufacture and in the requirement for service maintenance in the field. Such expenses are particularly significant in this business, in that it is quite usual for the cabinet to be provided and maintained at little or no cost to the establishment where it is installed as part of a contract for the supply of the paper towel.

DEFINITION OF THE INVENTION

It is therefore an object of the present invention to provide a new dispensing cabinet for strip material that is simple and robust mechanically, and consequently of relatively inexpensive construction and maintenance.

In accordance with the present invention there is provided a dispensing cabinet for strip material comprising:

a cabinet frame including a face cover plate having a vertical slot therein, the cabinet frame also providing a horizontal exit slot through which the strip material is dispensed form the cabinet interior;

a handwheel mounted by the cabinet frame for rotation about a horizontal axis and so as to protrude out of the cabinet through the vertical slot for engagement and rotation by the hand of a user;

the handwheel providing a plurality of circumferentially-spaced radically-extending ratchet teeth movable in a corresponding circular path about the horizontal axis for selective engagement by a ratchet member;

a boss member rotatable with the handwheel and engagable with a core of a roll of strip material so that rotation of the handwheel rotates the roll engaged by the boss; and a strip tearing member mounted by the cabinet frame adjacent the horizontal exit slot for pivoting movement about a horizontal axis, a horizontal edge of the member adjacent the slot constituting a tearing edge for the strip when it is pulled by a user into sufficiently strong contact therewith;

the strip tearing member carrying a ratchet member movable into the path of said ratchet teeth to engage the next succeeding ratchet tooth and prevent further rotation and dispensing of the strip material;

the strip tearing member being biased for movement about its pivot to normally hold the ratchet member out of the path of the ratchet teeth and permit dispensing of the strip, and being moved against the bias to move the ratchet member into said selective engagement with a ratchet tooth of the handwheel by the pulling of the strip against the tearing edge while the strip is thus retained against further dispensing.

Also in accordance with the invention there is provided a dispensing cabinet for strip material comprising:

a cabinet frame including a face cover plate having a vertical slot therein, the cabinet frame also providing a horizontal exit slot through which the strip material is dispensed from the cabinet interior;

a handwheel mounted by the cabinet frame for rotation about a horizontal axis and so as to protrude out of the cabinet through the vertical slot for engagement and rotation by the hand of a user;

the handwheel providing a plurality of circumferentially-spaced radically-extending ratchet teeth movable in a corresponding circular path about the horizontal axis for selective engagement by a ratchet member;

a boss member rotatable with the handwheel and engagable with a core of a roll of strip material so that rotation of the handwheel rotates the roll engaged by the boss; and a strip engaging member mounted by the cabinet frame adjacent the horizontal exit slot for pivoting movement about a horizontal axis, a horizontal edge of the member adjacent the slot being engageable by the strip when it is pulled by a user out of the exit slot;

the strip engaging member carrying a ratchet member movable into the path of said ratchet teeth to engage the next succeeding ratchet tooth and prevent further rotation and dispensing of the strip material;

the strip engaging member being biased for movement about its pivot to normally hold the ratchet member out of the path of the ratchet teeth and permit dispensing of the strip, and being moved against the bias to move the ratchet member into said selective engagement with a ratchet tooth of the handwheel by the pulling of the strip against the horizontal edge so that the strip is thus retained against further dispensing.

BRIEF DESCRIPTION OF THE DRAWINGS

A particular preferred embodiment will now be described, by way of example, with reference to the accompanying diagramatic drawings wherein.

DESCRIPTION OF THE PREFERRED EMBODIMENT

Figure 1:
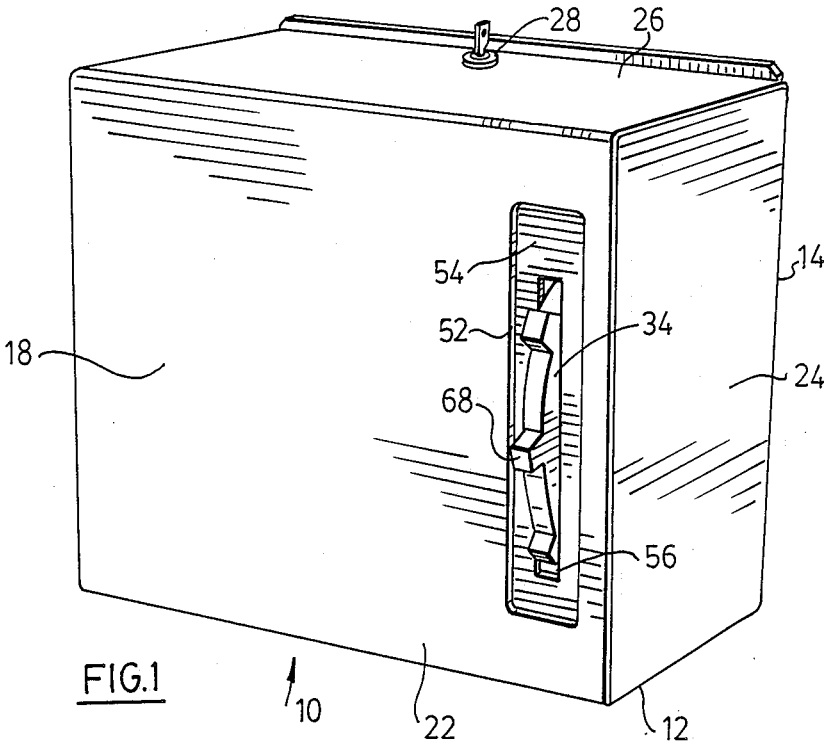
FIG. 1 is a perspective view of the cabinet in closed configuration, as seen by the user.

The cabinet frame 10 consists of a base portion 12 providing a bottom outside wall 14 and a rear outside wall 16, the latter being provided with apertures for the passage of fastening means (not shown) by which the cabinet is fastened to a wall at an appropriate height. The frame also consists of a cover portion 18 hinged at 20 to the base portion and providing front outside wall 22, side outside walls 24, and top outside wall 26. The top wall 26 carries a lock 28 engageable with a detent 30 on the rear wall 16 to secure the two portions together.

Figure 2:
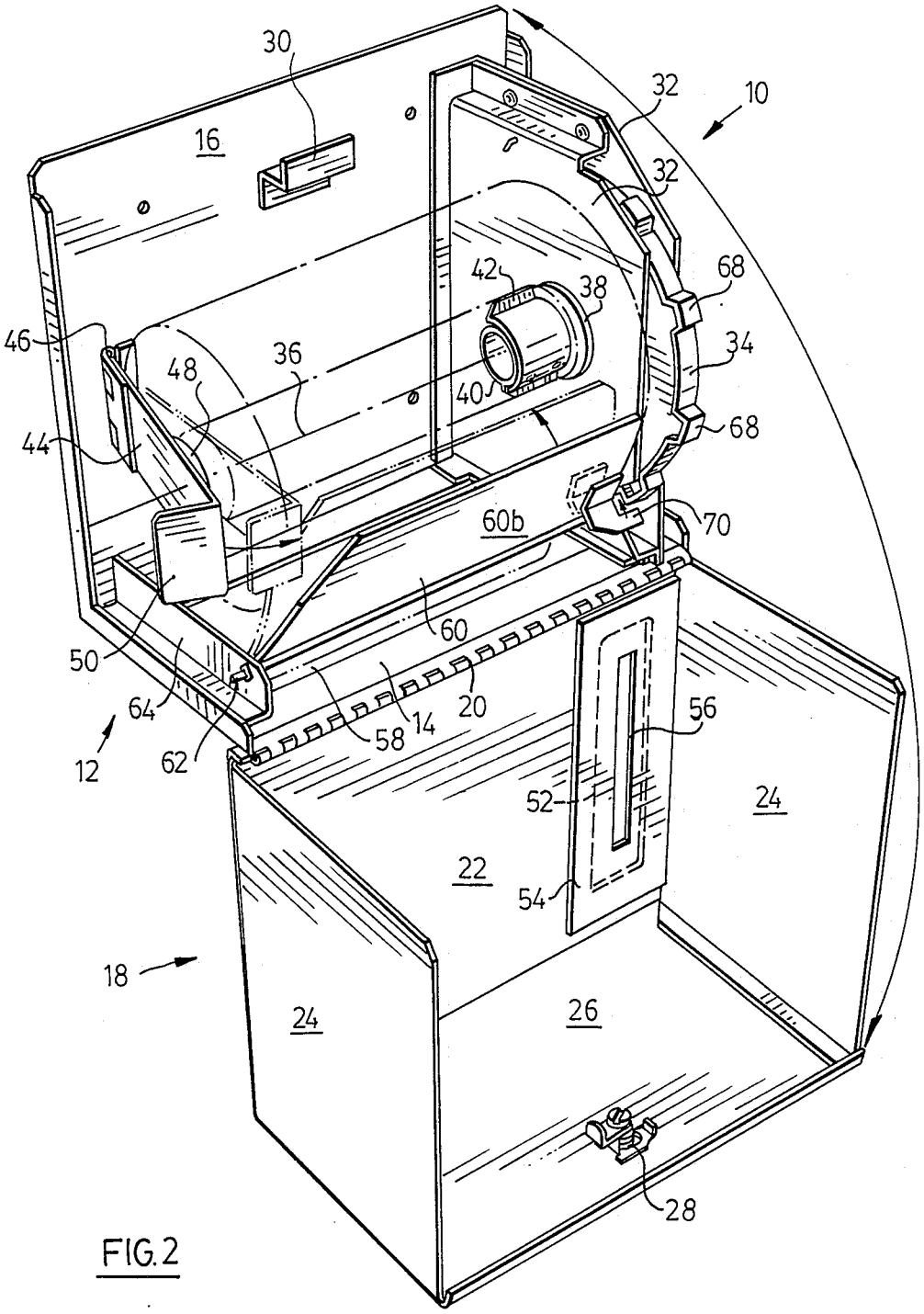
FIG. 2 is similar view with the cover portion of the cabinet frame moved to open position to reveal its interior and that of the base portion of the cabinet frame.

The base portion 12 is provided with two vertical, parallel, closely-spaced inner walls 32 between which is disposed a large vertical handwheel 34, the handwheel being mounted for rotation about a horizontal axis 36 by means of two integral smaller-diameter boss portions 38 (only one seen in FIG. 2) rotatable in corresponding coaxial apertures in the walls 32. The handwheel also has integral therewith a coaxial roll-engaging boss member 40 insertable in the hollow core of a paper roll 42. The member 40 has a fixed radial member 41 and a sharp spring mounted radial core-engaging member 42 extending oppositely therefrom, these radial members cutting into the roll core as the roll is forced thereon to ensure that it must thereafter rotate with rotation of the handwheel. The other end of the roll is supported by a bearing member 44 that is hinged at 46 to the rear wall 16, so that a protrusion 48 thereon can be engaged with a new roll and disengaged from an empty roll for removal A turned end 50 of the member 44 engages the inside face of adjacent side wall 24 as the cover is closed to hold the supporting protrusion 48 in positive engagement in the core.

With the cover portion closed the handwheel extends out of a vertical slot 52 in the front wall 22. The slot is made substantially larger than the handwheel, both vertically and horizontally, and the resultant larger space is filled with a sheet 54 of soft flexible material, such as a rubber, with a central slot 56 of such size that the sheet closely embraces the handwheel and thus mitigates against entrapment of the user's fingers between the handwheel and the slot edge as the handwheel is rotated downward to dispense the strip material.

The strip passes out of the cabinet through a horizontal slot 58 in the bottom wall 14, and a strip tearing/engaging member 60 is mounted immediately adjacent to this slot, the member consisting of a curved metal plate mounted for pivoting movement about a horizontal axis adjacent the slot by a pivot rod 62 extending between one inner wall 32 and a short parallel support wall 64. The plate is concave toward the roll and is mounted with a smaller lower portion **60*a* below the rod 62, between the rod and the plate lower horizontal edge 66, and with a larger upper portion 60*b* above the rod 62, so that the larger upper portion serves as weighted biasing means biasing the plate to normally rotate the upper portion outward away from paper roll to the position shown in solid lines in FIG. 3**, while the lower portion is moved inward toward the strip into close proximity thereto.

Figure 3:
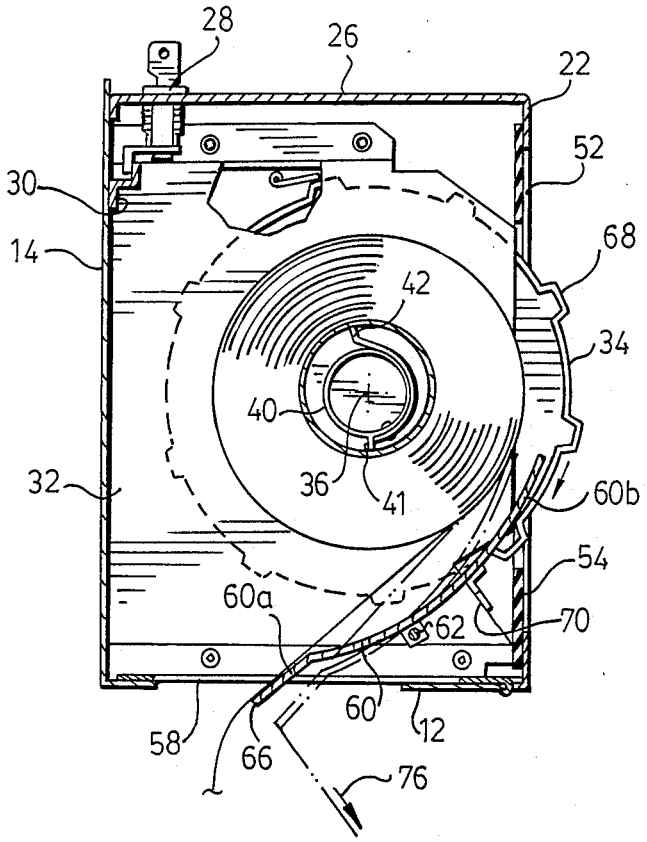
FIG. 3 is a cross-section taken on the line 3—3 of FIG. 1.

The handwheel is provided around its circumferential periphery with a plurality of relatively large, integrally-formed, uniformly-spaced, radially-extending protrusions 68, which constitute both ratchet teeth employed for controlling the dispensing of the strip material, and also finger-engaging members facilitating engagement of the user's hand with the wheel and its rotation to dispense the strip. The heavier plate upper portion **60*b* is provided close to the rod 62 with a horizontally-extending ratchet member 70 that, with the upper plate portion 60*b* in its normal outwardly-pivoted position, as shown in solid lines in FIG. 3, is clear of the ratchet teeth 68, so that the handwheel can be rotated downwards by the user to dispense the strip. However, upon the user pulling downward on the protruding end of the strip to try to obtain a much longer piece of strip by direct pull from the roll, the upper plate portion moves inward to the position shown in broken lines in FIG. 3, engaging the ratchet member 70 with the next adjacent ratchet protrusion 68**, whereupon the handwheel is locked against further dispensing rotation. The strip can therefore only be dispensed by operation of the handwheel and, since this is a much slower operation than simply pulling the strip from the roll, there is a marked tendency for the user to dispense only sufficient material for immediate use and not a wasteful too-long length.

Figure 4:
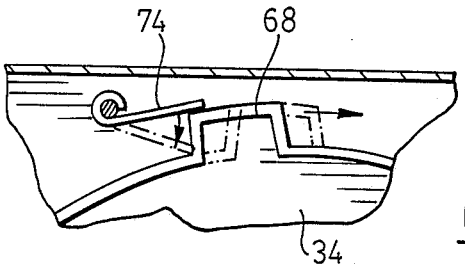
FIGS. 4 and 5 are partial cross-sections showing the operation of a unidirectional ratchet for the handwheel.
Figure 5:
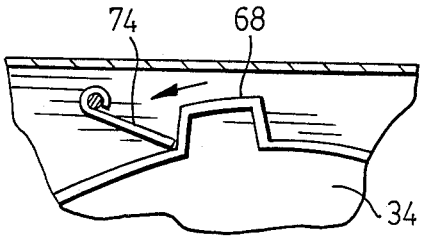

Once the user has dispensed a sufficient length in this manner all that is needed is to pull the strip sufficiently strongly in the forward direction (arrow 76 in FIG. 3), when the dispensed portion is readily torn from the roll by the forceful engagement of the strip with the relatively sharp lower edge 66 of the plate 60, this engagement also positively holding the ratchet member in engagement with the handwheel so that it cannot rotate while the tearing takes place. The handwheel is prevented from unwanted reverse rotation by a ratchet member 74 mounted between the inner walls 32, this member ratcheting freely over the protrusion 68 upon forward rotation (FIG. 4), and engaging with the next available protrusion 68 (FIG. 5) upon reverse rotation Although in this embodiment the protrusions 68 constitute both ratchet teeth and hand-engaging means in other embodiments the ratchet teeth may be provided on another wheel which is mounted coaxially with the handwheel and so as to be rotatable therewith. For example, it can be moulded integrally therewith, and also together with the boss portions 38 and the boss member 40. The strip tearing/engaging member 60 can alternatively be biased to its normal position by a spring biasing means rather that a weight biasing means, although the latter is both less expensive and less likely to require maintenance, and is therefore preferred.

It will be seen therefore that we have provided a dispensing cabinet that is of simple but highly effective construction and operation, requiring little or no maintenance while ensuring economical dispensing of the strip.

We claim:

1. A dispensing cabinet for strip material comprising:

a cabinet frame including a face cover plate having a vertical slot therein, the cabinet frame also providing a horizontal exit slot through which the strip material is dispensed form the cabinet interior;

a handwheel mounted by the cabinet frame for rotation about a horizontal axis and so as to protrude out of the cabinet through the vertical slot for engagement and rotation by the hand of a user;

the handwheel providing a plurality of circumferentially-spaced radically-extending ratchet teeth movable in a corresponding circular path about the horizontal axis for selective engagement by a ratchet member;

a boss member rotatable with the handwheel and engagable with a core of a roll of strip material so that rotation of the handwheel rotates the roll engaged by the boss; and a strip tearing member mounted by the cabinet frame adjacent the horizontal exit slot for pivoting movement about a horizontal axis, a horizontal edge of the member adjacent the slot constituting a tearing edge for the strip when it is pulled by a user into sufficiently strong contact therewith;

the strip tearing member carrying a ratchet member movable into the path of said ratchet teeth to engage the next succeeding ratchet tooth and prevent further rotation and dispensing of the strip material;

the strip tearing member being biased for movement about its pivot to normally hold the ratchet member out of the path of the ratchet teeth and permit dispensing of the strip, and being moved against the bias to move the ratchet member into said selective engagement with a ratchet tooth of the handwheel by the pulling of the strip against the tearing edge while the strip is thus retained against further dispensing.

2. A dispensing cabinet as claimed in claim 1, wherein the tearing edge is disposed between the horizontal exit slot and the handwheel horizontal axis, so that pulling of the strip by a user through the exit slot rotates the tearing member to engage the ratchet member with a ratchet tooth and thereby prevent any substantial dispensing of the strip other than by rotation of the handwheel with the ratchet released.

3. A dispensing cabinet for strip material comprising:

a cabinet frame including a face cover plate having a vertical slot therein, the cabinet frame also providing a horizontal exit slot through which the strip material is dispensed from the cabinet interior;

a handwheel mounted by the cabinet frame for rotation about a horizontal axis and so as to protrude out of the cabinet through the vertical slot for engagement and rotation by the hand of a user;

the handwheel providing a plurality of circumferentially-spaced radically-extending ratchet teeth movable in a corresponding circular path about the horizontal axis for selective engagement by a ratchet member;

a boss member rotatable with the handwheel and engagable with a core of a roll of strip material so that rotation of the handwheel rotates the roll engaged by the boss; and a strip engaging member mounted by the cabinet frame adjacent the horizontal exit slot for pivoting movement about a horizontal axis, a horizontal edge of the member adjacent the slot being engageable by the strip when it is pulled by a user out of the exit slot;

the strip engaging member carrying a ratchet member movable into the path of said ratchet teeth to engage the next succeeding ratchet tooth and prevent further rotation and dispensing of the strip material;

the strip engaging member being biased for movement about its pivot to normally hold the ratchet member out of the path of the ratchet teeth and permit dispensing of the strip, and being moved against the bias to move the ratchet member into said selective engagement with a ratchet tooth of the handwheel by the pulling of the strip against the horizontal edge so that the strip is thus retained against further dispensing.

4. A dispensing cabinet as claimed in any one of claims 1 to 3, wherein the ratchet teeth extend radially outwards from the circumferential periphery of the handwheel and also constitute finger-engaging members facilitating hand engagement of the user with the handwheel and its rotation.

5. A dispensing cabinet as claimed in any one of claims 1 to 3, wherein the boss member and the handwheel are integral with one another.

6. A dispensing cabinet as claimed in claim 1 or 2, wherein the strip tearing member has a smaller portion thereof below its horizontal pivot and providing the horizontal tearing edge, and a larger portion thereof above the horizontal pivot, the larger portion constituting counterweight means biasing the strip tearing member to normally hold the ratchet member out of the path of the ratchet teeth.

7. A dispensing cabinet as claimed in claim 3, wherein the strip engaging member has a smaller portion thereof below its horizontal pivot and providing the horizontal strip engaging edge, and a larger portion thereof above the horizontal pivot, the larger portion constituting counterweight means biasing the strip engaging member to normally hold the ratchet member out of the path of the ratchet teeth.

8. A dispensing cabinet as claimed in any one of claims 1 to 3, wherein the vertical slot in the cabinet face cover plate is substantially larger than the handwheel and the portion of the slot surrounding the handwheel is closed by flexible sheet material to mitigate entrapment of a user's fingers between the handwheel and the slot edge.

* * * * *